United States Patent [19]

Anderson, Jr. et al.

[11] 3,986,417

[45] Oct. 19, 1976

[54] METHOD OF AND APPARATUS FOR HANDLING FILAMENTS

[75] Inventors: Charles H. Anderson, Jr., Shoreham; Charles E. Drewes, Middlebury; Richard G. Hayes, Brandon, all of Vt.

[73] Assignee: Polymers Inc., Middlebury, Vt.

[22] Filed: Mar. 25, 1975

[21] Appl. No.: 561,927

[52] U.S. Cl. ..... 83/23; 83/89; 83/115; 83/356.3; 83/913

[51] Int. Cl.[2] ..... B26D 3/16

[58] Field of Search ..... 83/23, 22, 89, 84, 115, 83/114, 113, 913, 355, 356.3

[56] References Cited

UNITED STATES PATENTS

| | | | |
|---|---|---|---|
| 2,217,766 | 10/1940 | Neff | 83/402 |
| 2,391,719 | 12/1945 | Llewellyn | 83/356.3 |
| 2,821,253 | 1/1958 | Heffelfinger et al. | 83/252 |
| 2,846,004 | 8/1958 | Fotland | 83/355 |
| 3,104,579 | 9/1963 | Blankenship et al. | 83/355 |
| 3,367,222 | 2/1968 | Mummery | 83/174 |
| 3,776,079 | 12/1973 | Steinberg et al. | 83/356.3 |
| 3,822,621 | 7/1974 | Knights et al. | 83/23 |

*Primary Examiner*—Donald R. Schran
*Attorney, Agent, or Firm*—Morgan, Finnegan, Pine, Foley & Lee

[57] ABSTRACT

A method of and apparatus for cutting and handling filaments which controls the vertical, lateral and axial movement of the filament during and after cutting to maintain filament in alignment while removing cut filament from the path of incoming filament. In accordance with the present invention filament is fed into an annular chamber formed by a rotary drum and an annular shroud in the direction of its longitudinal axis, and cut into lengths with a knife mounted on the forward end of the rotary drum as the knife is rotated through the incoming filament. During and after cutting, erratic vertical, axial and lateral movement of cut filament is confined by the walls of the chamber, by an adjustable stop within the chamber downstream of the knife positioned at the desired filament length, and by picking means mounted on the length of the drum within the chamber which closely follow the knife and contact the filament immediately after it has been cut. Simultaneously, the picking means removes the cut filament from the path of incoming filament. Also, in accordance with the present invention, deflectors along the length of the drum deflect the removed, cut filament from the pickers into a vertical passageway which opens to a filament collection trough.

16 Claims, 10 Drawing Figures

METHOD OF AND APPARATUS FOR HANDLING FILAMENTS

FIELD OF THE INVENTION

This invention relates to cutting filaments, such as filament of the synthetic brush-type, and more particularly to a method of and apparatus for cutting filament into precise lengths and maintaining the cut filament in axial, vertical and lateral alignment while being removed from the path of incoming filament.

In the following specification and in the claims references to "filament" and "cut filament" generally are intended to refer to a plurality of filaments being processed and handled as a group.

BACKGROUND OF THE INVENTION

Prior to this invention, when continuous lengths of filament from an extrusion operation or from another source have been cut, substantial difficulties have been encountered in handling and removing the cut filament. The incoming uncut filament travels at relatively high rates of linear speed. When cut, the filament tends to be scattered in random directions because the impact from cutting tends to throw one end of the filament ahead of the other. At the same time the cut filament tends to interfere with incoming filament.

It is, therefore, an object of this invention to provide a method of and apparatus for cutting and handling filament which overcome the described problems.

Among the other objects of this invention are to provide a method and apparatus which limit and control the erratic movement of cut filament and which remove such filament from the path of filament to be cut.

Additional objects and advantages will be set forth in part hereinafter and in part will be obvious herefrom or may be learned with the practice of the invention, the same being realized and obtained by means of the apparatus recited in the appended claims.

SUMMARY OF THE INVENTION

In accordance with the invention there is provided a method for continuously cutting and handling filaments comprising feeding filament into an annular chamber in the direction of the longitudinal axis of the filament and the chamber, cutting the filament into lengths in the chamber with a movable knife, confining the vertical, axial and lateral movement of the cut filament within the annular chamber during and after cutting, and removing the cut filament from the path of incoming filament as it is cut to prevent interference with incoming filament.

Apparatus of the invention for cutting and handling filaments, includes a rotary drum, a shroud spaced from said rotary drum and forming therewith an annular chamber, and means for feeding filaments into the annular chamber. A cutting knife is mounted on the forward end of the drum and extends across the annular chamber, and is rotated with the drum for cutting the incoming filaments into precise lengths. As the filament is cut the walls of the annular chamber limit erratic vertical movement of the filaments, while an adjustable stop in the annular chamber downstream of the incoming filaments limits the axial or linear movement of the cut filaments. In addition, picker means positioned on the length of the drum, extend across the annular chamber and closely follow the filament cutting knife for limiting the lateral movement of cut filament and for removing it from the path of the incoming filament. Deflectors positioned along the length of the drum deflect the cut filament from the pickers into a collection trough.

By the practice of the present invention: (1) the vertical, axial and lateral movements of cut filament is carefully controlled during and after cutting, and (2) cut filament is promptly removed from the path of incoming filament. In doing so the present invention provides cut filament which is in alignment and which is considerably easier to handle.

BRIEF DESCRIPTION OF THE DRAWINGS

The following is a detailed description together with accompanying drawings of a preferred embodiment of the invention. It is to be understood that the invention is capable of modification and variation apparent to those skilled in the art within the spirit and scope of the invention. In the drawings:

Referring to FIGS. 1–3, the illustrated filament cutting and handling apparatus 10 of the invention includes a pair of vertically spaced housing plates 12 and 14 secured to one side of a conventional supporting frame (not shown). Between the plates 12 and 14 is housed a rotary drum 16 about which, and spaced from, is a shroud 18. Defined by the spaced shroud 18 and drum 16 is an annular chamber 20 into which filament can be fed from an extruding operation or from another source.

Figure 1:
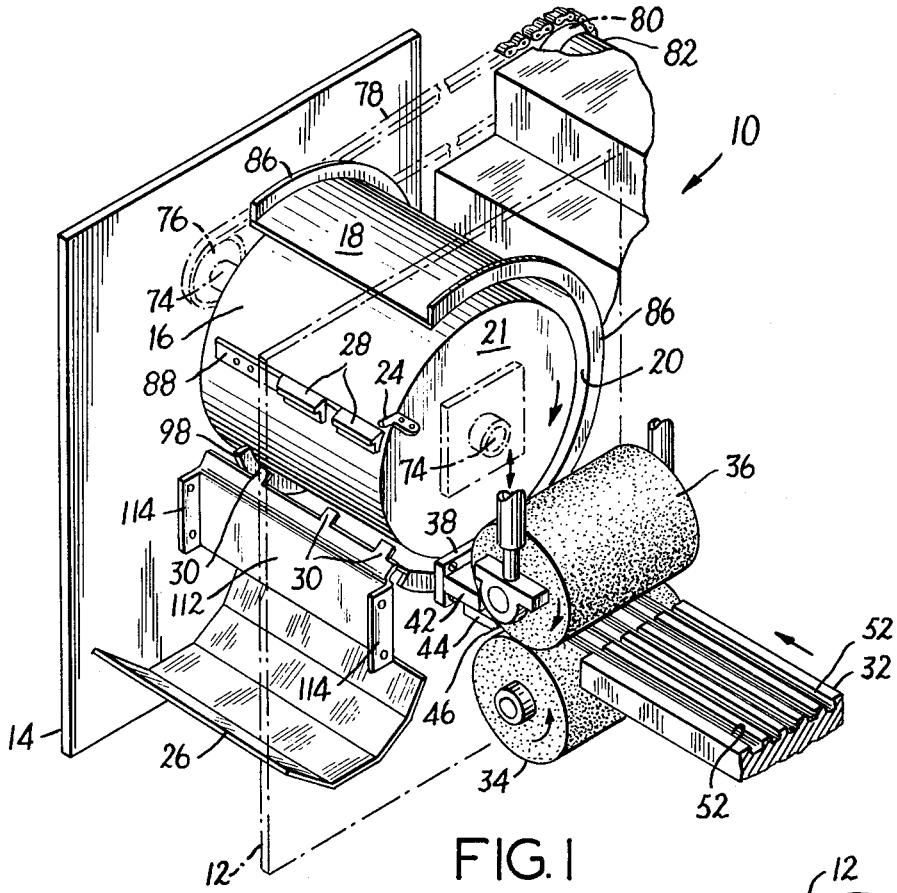
FIG. 1 is an isometric view of the preferred embodiment of the apparatus of the invention, and, as shown, includes the rotary drum and the annular shroud with the cutting knife, picker bars and adjustable stop in the annular chamber, as well as the deflectors for deflecting cut filament into the collection trough.

Secured to the front face 21 of the drum 16 and rotatable in the annular chamber 20 is a cutting knife 24 which cuts the filament into precise lengths. At the forward and lower end of the chamber 20 is a vertical passageway 22 extending downwardly from the chamber 20 to a filament collection trough 26. Along the length of the drum 16 and closely following the knife 24 are picker bars 28 which remove the cut filament from the incoming continuous lengths of filament, and in cooperation with deflectors 30, cause the cut filament to drop into passageway 22 and trough 26.

As shown in FIG. 1 the uncut filament is fed to the apparatus 10 through a channeled guide 32 by pinch rollers 34 and 36. The upper roller 36 is an idler roller and the lower roller 34 is rotated by conventional variable speed drive means (not shown). To guide the filament from the rollers 34, 36 into the chamber 20, the apparatus 10 includes guide means having a shear plate 38 which slidably extends into an opening 40 in the plate 12 and is fastened to the plate 12 by screws 41. Extending from and secured to the shear plate 38 is a guide block 42. In turn, a guide plate 44 is secured to the underside of the guide block 42 which has a tapered end 46 extending to the nip of the roller 34, 36.

Through guide block 42 and shear plate 38 extend five aligned holes 48, 50 which open to the bottom of the chamber 20. Further, the holes 48, 50 are arranged on a radius which corresponds to the sweep of the filament cutting knife 24. Several strands of filaments are fed from each of the five grooves 52 in the channel guide 32 through rollers 34, 36 and as shown in FIGS. 4 and 4A, through each aligned hole 48 and 50 into the bottom of the chamber 20 for cutting by the knife 24.

Figure 4:
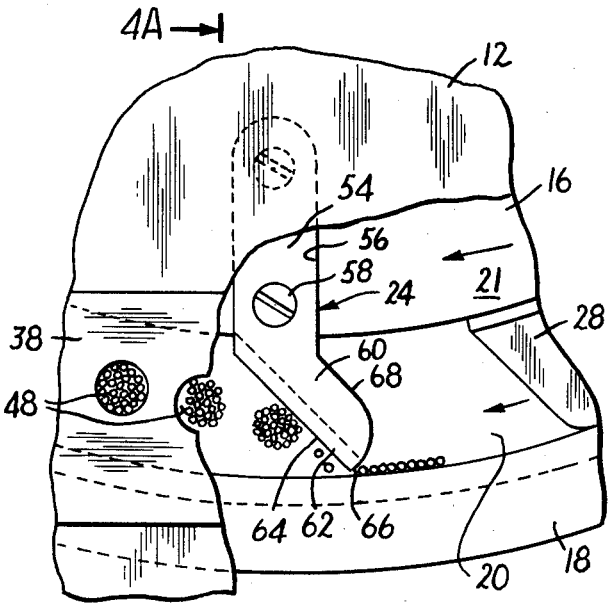
FIG. 4 is a side view, illustrating the cutting knife, its filament cutting action, and the spacial relationship between the pickers and the filament cutting knife.
Figure 4A:
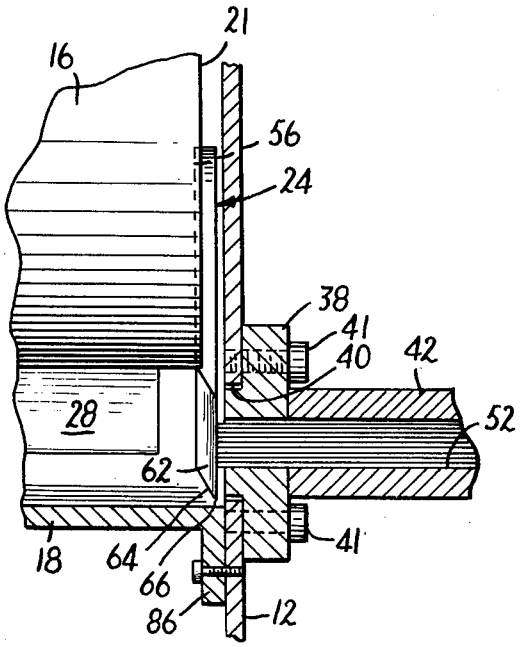
FIG. 4A is a sectional view of FIG. 4, taken along the lines 4A—4A.

The filament cutting knife 24 includes an arm 54 held in a recess 56 on the drum face 21 by screws 58, as shown in FIG. 4. Extending rearwardly from the arm 54 and across the chamber 20 at an acute angle of about 45° is a knifeblade 60. The blade 60 includes a tapered side 62 to provide a leading knife edge 64 which shears incoming filaments into precise lengths. In cutting filament, the walls of the shear plate 38 about the holes 48 hold the filament and provide an opposing force to the shearing force of the knife 24. To prevent binding or wedging of the knife 24 in the chamber 20 the tip 66 of the blade portion slopes rearwardly in an arc to the trailing edge 68 of the blade 60.

The drum 16 includes end plates which form the front and rear faces 21 and 70, respectively, and a cylindrical tube therebetween. In the illustrative embodiment the drum is about 11 inches in diameter and about 14 inches in length. It is hollow and the end plates and tubing are made of metal.

For rotation of the drum 16 and the knife 24, the drum 16 includes a shaft 74 which extends through and is journaled in the plates 12 and 14. At the rear end plate 14 the shaft 74 is connected to a variable speed drive means which includes a pulley 76 secured to the outer end of the shaft 74, a chain belt 78 connected to the pulley 76 and a pulley 80 connected to a variable speed motor 82 (partially shown).

In the illustrative embodiment the drum 16 is rotated at a speed relative to the linear speed of the incoming filament to provide the desired length of filament for each rotation of the knife 24. For example, to produce cut filament 12 inches in length from uncut filament being fed into the chamber at 100 feet per minute the drum 16 is rotated 100 RPM. Typically, to produce cut filament from about 10 inches to 14 inches the filament can be fed into the chamber 20 at the rate from about 40 to 200 feet per minute and the drum 16 can be rotated at speed of from about 42 RPM to 240 RPM.

The annular shroud 18 includes tubing having a curvature which is complementary to the curvature of the drum 16. The shroud 18 is spaced from the drum 16 a distance sufficient to facilitate cutting of filament while limiting its axial movement during and after cutting. In the illustrative embodiment the shroud 18 has an inside diameter of about 13 inches and is spaced about 0.75 inches from the drum 16, to thereby provide an annular chamber 20 having a breadth of about 0.75 inches.

The shroud 18 is held in position by its outwardly turned annular flanges 86 which are fastened to the plates 12 and 14. To facilitate adjustment and maintenance of the apparatus 10, the front portion of the shroud has been removed.

Figure 2A:
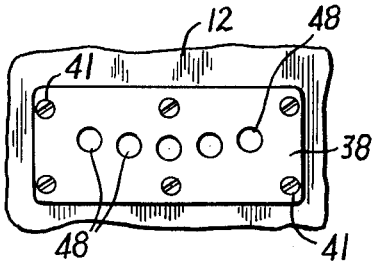
FIG. 2A is a detail view, taken along the lines 2A—2A, illustrating the shear plate used to position filaments for cutting.
Figure 2:
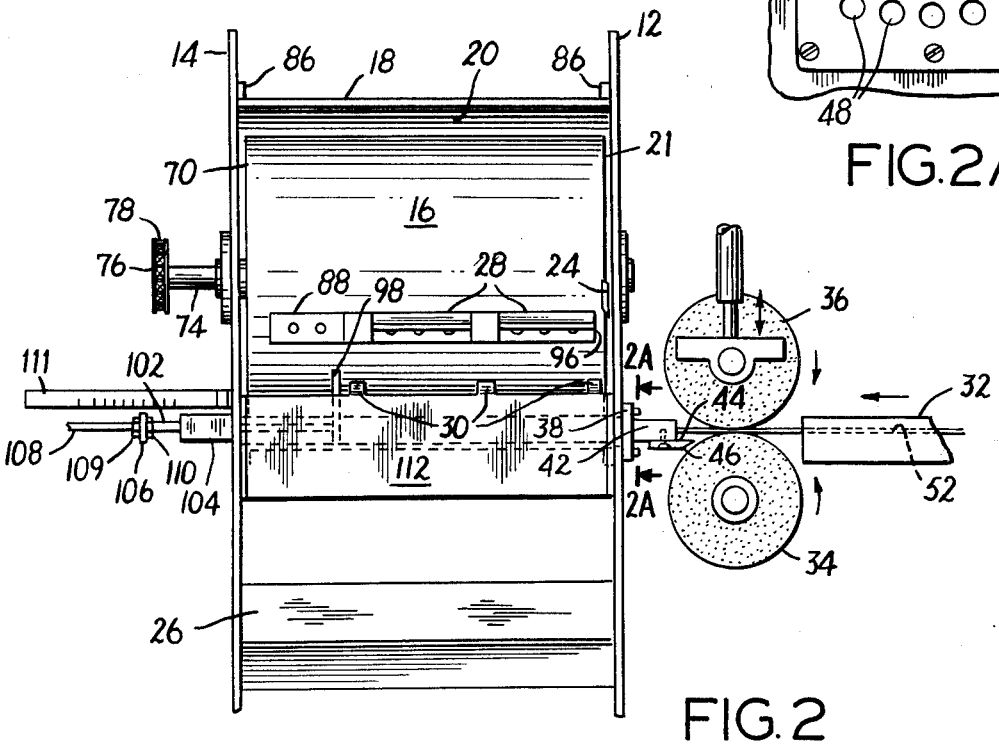
FIG. 2 is a front view of the apparatus of the invention.

The picker bars 28 are secured to the drum 16 in recesses spaced along its length to closely trial the cutting knife 24. As shown in FIGS. 1 and 2 the picker bars 28 are spaced apart from another to allow for passage of the deflectors 30 as the bars 28 are rotated with the drum 16. The number of picker bars used will depend upon the desired length of cut filaments. In the illustrated embodiment, there are three recesses 88 and two picker bars 28.

Figure 5:
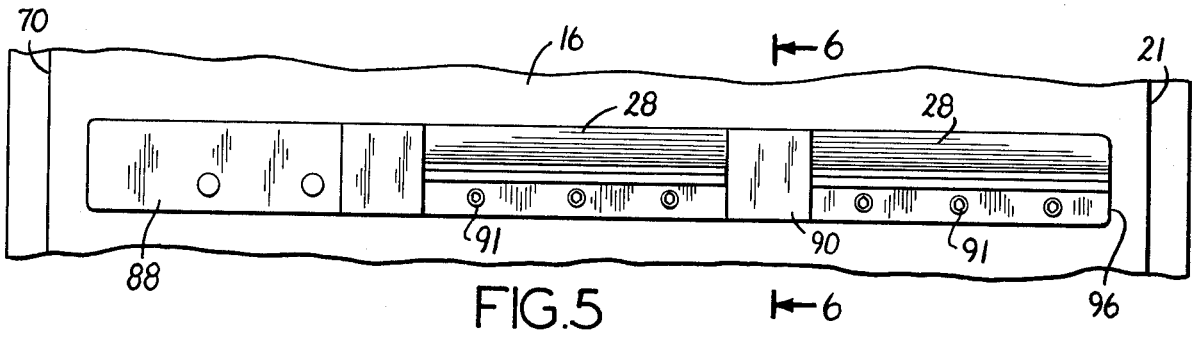
FIG. 5 is a front view of the picker bars of the invention.
Figure 6:
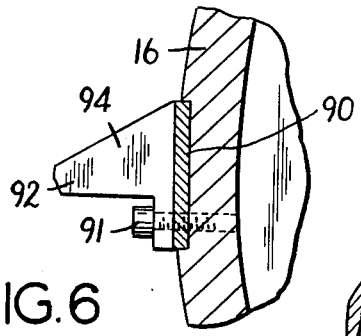
FIG. 6 is a sectional view of FIG. 5, taken along the lines 6—6.

As illustrated in FIGS. 5 and 6, each picker bar 28 includes a back plate 90 which slidably fits into a recess 88 where it is secured to the drum 16 by drums of screws 91.

From each backplate 90 a truncated triangular portion 92 extends across the chamber 20. The leading surface 94 is the hypotenuse of the triangular portion and forms an acute angle with the backplate 90. This acute angle is sufficient to move cut filament out of the path of incoming filament and to prevent the cut filament from going beyond the deflection 30, without causing wedging of filament in the shroud 18. In the illustrative embodiment this angle is about 60°.

The leading portion 96 of the picker bar 28 adjacent the incoming filament, moreover, is recessed from the front face 22 of the drum 16 to prevent interference with the incoming uncut filament.

In the illustrative embodiment the leading portion 96 of the first picker bar 28 is longitudinally spaced downstream of the knife about 1 inch and the picker bars 28 are radially spaced 0.125 of an inch in back of the knife 24.

As discussed at the outset of this application the shearing action of knife 24 tends to cause erratic vertical and lateral movement of the cut filament during and after cutting. This is caused, in substantial part, by the required relative position of the knife to the filament and the movement of the knife through the filament for proper cutting. As shown in FIG. 4 of the illustrative embodiment of this invention, the knife edge 64 forms a rearwardly extending acute angle with respect to each group of incoming filaments. In cutting, moreover, the knife edge 64 does not simultaneously cut each filament of the group. Rather, the knife edge 64 moves through the incoming filaments in sequential manner. In doing so, the upstream portion of the filament being cut tends to be deflected downwardly and forwardly while the downstream portion of the filament tends to move rearwardly and upwardly.

With the present invention, however, this erratic movement is controlled to provide aligned cut filaments. Erratic lateral movement of the filament during and after cutting is limited by the picker bars 28 which closely follow and immediately contact and carry the filament forward within the annular chamber. At the same time the walls of the drum 16 and shroud 18 limit any erratic axial movement of the filament during and after being cut. Further, the shroud 18 temporarily holds cut filament which tend to move downwardly before contact by the closely trailling picker bars 28. Thus, the immediate contact between the cut filament and the picker bars 28 and the walls of the shroud 18 and drum 16 control any erratic lateral and vertical movement of cut filament.

Figure 8:
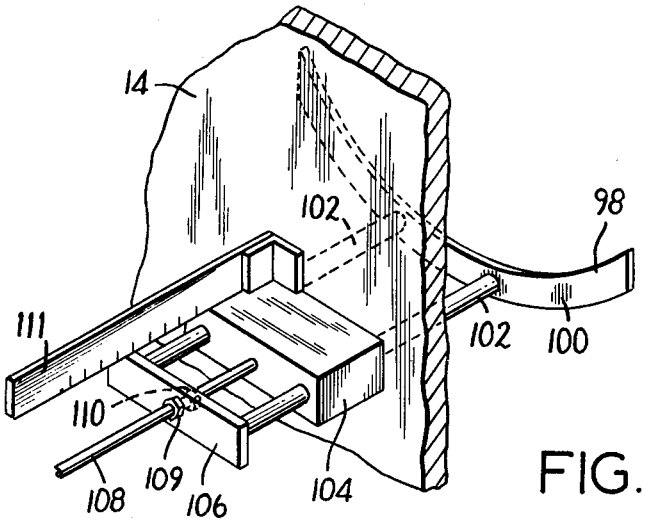
FIG. 8 is an isometric detail view of the adjustable stop of the invention.

Also, impact of the knife 24 upon adjacent filaments may vary, causing the filaments to move within the chamber 20 at different speeds. To prevent axial misalignment of the cut filament, the apparatus 10 includes an adjustable stop 98, shown in FIG. 8.

The stop 98 has a bar 100 which is slidable within the chamber 20 and is adjustably positioned downstream of the knife 24 at the desired filament length.

The bar 100 is in the form of an arc which conforms to the shape of chamber 20 and is of sufficient length to restrict axial movement of cut filament and maintain them in alignment with the other cut filament.

To adjust the position of the bar 100, the stop 98 includes a pair of guide rods 102 secured at their inner ends to the rear of the bar 100 which slidably extend through the plate 14, a guide block 104, and are secured at their outer ends to a locking plate 106. Intermediate the rods 102 is an adjustment rod 108 which extends through the locking plate 106 and is at its inner end secured to the guide block 104. To move the bar 100 within the chamber locking nuts 109 and 110 positioned on either side of the plate 106 are moved in the desired direction. This allows the guide rods 102 and attached bar 100 to be moved toward or away from the knife 24.

For proper positioning of the bar 100 the adjustable stop includes an indicator 111 in the form of a rectangular bar secured to the plate 14 and extending rearwardly over the locking plate 106. Indicia on the indicator 111 in the form of lines corresponds to the desired cut length of the filament. When the bar 100 has been moved to its desired position the locking nuts are tightened and the bar 100 is in its proper position.

Figure 7:
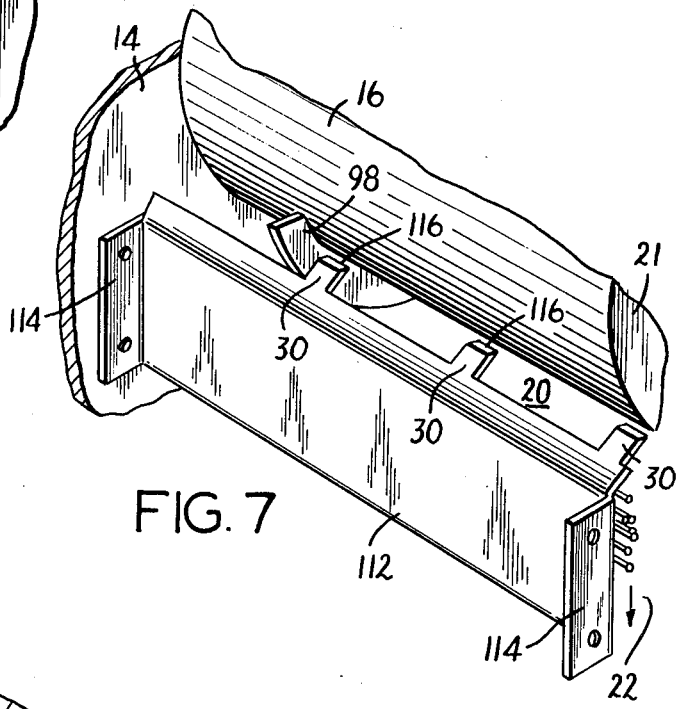
FIG. 7 is an isometric detail view of the deflectors, rotary drum and adjustable stop.

As shown in FIG. 7, the deflectors 30 are part of a vertical bar 12 which extends across the lower portion of the drum 16 and is spaced from the lower end of the shroud 18. The bar 112 is fixed in this position by means of its outwardly turned end flanges 14 which are secured to the plates 12 and 14. The deflectors 30 are in the form of fingers which extend inwardly from the bar 112 toward the drum 16 between the picker bars 28 and the ends of the drum 16. Each deflector 30 forms an obtuse angle with the vertical bar 112 to deflect cut filaments without a wedging. To further eliminate the possibility of wedging, the tips 116 of each finger 30 is tapered so that its upper surface juxtaposed the drum 16 is substantially parallel thereto. In use, filaments being carried by the picker bars 28 contact and are deflected by the deflectors 30, whereupon the deflected filaments drop through the passageway 22 and into the collection trough 24.

Figure 3:
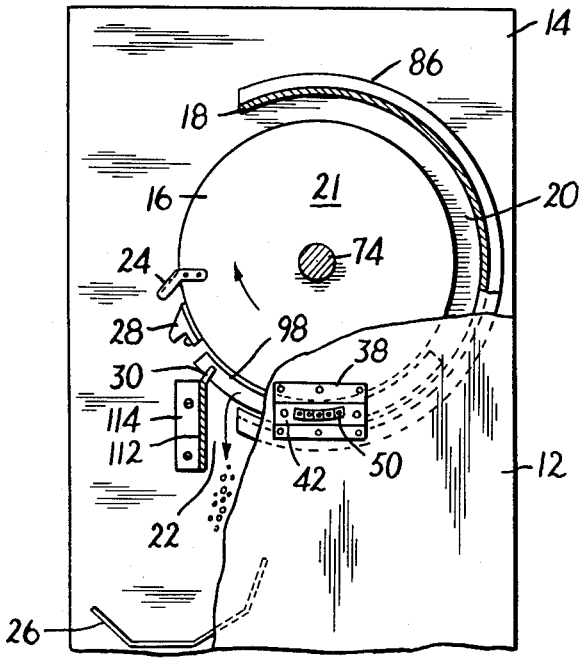
FIG. 3 is a side view of the apparatus of the invention with the forward housing plate partially broken away.

As shown in FIGS. 1 and 3, the passageway 22 is defined by the space formed between the lower end of the shroud 18 and the deflector bar 112. At its lower end the passageway 22 opens to the collection trough 26 secured to and between the lower end of the plates 12 and 14. The trough 26 is a plate having four panels each of which forms an obtuse angle with the adjacent panel and with the outer panels extending upwardly for collection of filament.

The illustrated method and apparatus of the present invention is particularly useful for the cutting and handling of brush type synthetic fibers or filaments, such as heavy gauge polyamide, polyethylene, polypropylene, polyvinyl chloride and polystryrene filaments. Typically, the cut filaments can be about 10 to 14 inches in length and about 0.020 to 0.060 of an inch in cross section.

When lighter gauge, self-supporting filaments are being cut, the walls of the shroud 18 can be recessed to receive the rotating picker bars 28. In this way light gauge cut filaments will not escape from the sweeping action of the picker bars.

Moreover, when desired a plurality of knives 24 can be spaced about the face of the drum 16 to provide for a multiplicity of filament cuts for each rotation of the drum.

In operation of the illustrative embodiment of the invention, filament is continuously fed from the channeled guide 32 through rollers 34 and 36, through the guide block 42 and shear plate 38, and into the bottom of the annular chamber 20. In practice, about twenty to fifty strands of filament can be grouped into two to five bundles and are cut by the shearing action of the knife 24 into precise lengths.

The cut filament is immediately removed from the path of the incoming filament by the picker bars 28 while the walls of the chamber 20 and the stop 98 confine and limit the lateral and axial movement of such filament. The aligned cut filament being carried forward by the pickers 28 are then deflected into passageway 22 by deflectors 30. From the passageway 22 the filament descend into the collection trough 24 ready for further handling.

The invention in its broader aspect is not limited to the specific described embodiments and departures may be made therefrom within the scope of the accompanying claims without departing from the principals of the invention and without sacrificing its chief advantages.

What is claimed is:

1. A method for continuously cutting and handling filaments which controls the vertical, lateral and axial movement of the filament during and after cutting to maintain filament alignment while removing the cut filament from the path of incoming filament, comprising: continuously feeding filament into an annular chamber formed by a rotary drum and an annular shroud in the direction of the longitudinal axis of the filament and the length of the chamber and wherein the chamber is at least the length of the cut filament, cutting the filament into lengths with a knife mounted on the forward end of the rotary drum, confining the vertical, lateral and axial movement of the filament within the annular chamber along the length thereof during and after cutting, and concurrently removing said cut filament from the path of continuously incoming filament as it is cut to prevent interference with the incoming filament.

2. The method for cutting and handling filaments set forth in claim 1 wherein the filaments are fed into the bottom of the annular chamber and cut by the knife into precise lengths as the knife is rotated through the bottom of the annular chamber.

3. The method set forth in claim 2, comprising continuously deflecting the cut filament after they have been removed from the path of the incoming filament into a vertical passageway, and collecting the cut filament as they drop from the vertical passageway.

4. A method for continuously cutting and handling filaments which controls the vertical, lateral and axial movement of the filament during and after cutting to maintain filament alignment while removing cut filament from the path of incoming filament, comprising:

continuously feeding filament into the bottom of an annular chamber formed by a rotary drum and an annular shroud in the direction of the longitudinal axis of the filament and the length of the chamber, cutting the filament into precise lengths with a rotating knife mounted on the forward end of the rotary drum as it sweeps through the bottom of the annular chamber, confining erratic vertical movement of the cut filament by the walls of the annular chamber during and after cutting, simultaneously confining erratic lateral movement of the cut filament during and after cutting and moving the cut filament from the path of continuously moving incoming filaments with pickers which are on the length of the drum and which rotate within the annular drum and contact the filament immediately after it is cut, confining the axial movement of filament within the chamber by an adjustable stop positioned downstream of the knife at the desired filament length, deflecting the cut filament from the pickers into a vertical passageway after the cut filament has been removed from the path of the incoming filament, and collecting the cut filament from the vertical passageway.

5. The method for cutting and handling filaments set forth in claim 4, comprising feeding filament fed into the bottom of the annular chamber in groups which follow a radius that corresponds to the sweep of the rotating cutting knife, and sequentially cutting each group of filaments with the knife as it is rotated by the drum within and through the bottom of the annular chamber.

6. Apparatus for cutting and handling filaments which controls the vertical, lateral and axial movement of cut filament during and after cutting to maintain the filament in alignment while removing cut filament from the path of incoming filament, comprising: a rotary drum, an annular shroud spaced from said rotary drum and forming therewith an annular chamber, means for feeding filament into said annular chamber, a cutting knife mounted on the forward end of said drum which extends across said annular chamber and is rotated with the drum for cutting the incoming filament into lengths, picker means on the length of the drum which extend across the annular chamber and closely follow said filament cutting knife for limiting lateral movement of cut filament and for removing cut filament from the path of incoming filament, an adjustable stop within the annular chamber downstream from the incoming filament for limiting the axial movement of the cut filament while the walls of said annular chamber formed by said drum and shroud limit the vertical movement of said cut filament, and deflecting means positioned along the length of the drum for deflecting the cut filament from said pickers after the cut filament is removed from the path of the incoming filament.

7. The apparatus for cutting and handling filaments set forth in claim 6, wherein said filament feeding means feed filament into the bottom of said annular chamber in groups which follow the sweep of said rotating knife, and wherein said knife sequentially cuts each group of filament into a precise length.

8. The apparatus for cutting and handling filaments set forth in claim 7, wherein said knife includes an arm mounted on the forward end of said drum positioned downwardly when said knife is rotating through the bottom of said annular chamber, and a knife blade which depends from said arm and which extends rearwardly therefrom at an acute angle and which shears incoming filament of each group into a precise length as said knife blade is swept through the bottom of said chamber.

9. The apparatus for cutting and handling filament set forth in claim 6, comprising a plurality of knives mounted on and spaced about the forward end of said rotary drum each of which cuts filament as it is swept through the bottom of said chamber.

10. The apparatus for cutting and handling filaments set forth in claim 6, wherein said deflector means include deflectors positioned along the length of said rotary drum up from and in front of the bottom of said annular chamber for deflecting cut filament from said picker means as they are rotated upwardly from the bottom of said chamber by said rotary drum.

11. The apparatus for cutting and handling filaments set forth in claim 10, wherein said picker means includes a plurality of bars spaced apart and extending from said drum across said annular chamber, and wherein said deflectors are positioned between said picker bars and at the ends of said drum.

12. The apparatus for cutting and handling filaments set forth in claim 6, wherein said adjustable stop comprises an arcuate shaped bar slidably mounted in said annular chamber downstream from said knife at the desired length of cut filament, means connected to said bar and extending rearwardly therefrom through said annular chamber, for moving said bar within said chamber and a locking device connected to said means for locking said means when said bar is at the desired position within said chamber.

13. The apparatus for cutting and handling filaments set forth in claim 12, wherein said means connected to said bar are rods, and wherein said adjustable stop includes an indicator having indicia thereon corresponding to the distance said bar is within said chamber, said indicator being positioned relative to said rods so that correlation of the movements of said rods with the indicia on said indicator properly positions said bar within said chamber.

14. The apparatus for cutting and handling filaments set forth in claim 6, wherein said shroud is open at its front to facilitate maintenance and operation of the apparatus, and wherein said apparatus comprises a vertical passageway between and depending from the bottom of the front of said shroud and from said deflectors into and through which deflected cut filaments pass, and a collection trough beneath said vertical passageway for collecting the cut filament.

15. The method for cutting and handling filaments set forth in claim 4 wherein the filaments are synthetic and include brush type fibers and filaments.

16. The method for cutting and handling filaments set forth in claim 15 in which the filaments are cut into lengths of from about 10 inches to about 14 inches.

* * * * *